US007021507B2

(12) United States Patent
Choi et al.

(10) Patent No.: US 7,021,507 B2
(45) Date of Patent: Apr. 4, 2006

(54) FOLDING AND EXPANDING TOP WEAR HANGER

(76) Inventors: Junwon Choi, 33 Augusta, Irvine, CA (US) 92620; Sunjin Hyun, 33 Augusta, Irvine, CA (US) 92620

( * ) Notice: Subject to any disclaimer, the term of this patent is extended or adjusted under 35 U.S.C. 154(b) by 452 days.

(21) Appl. No.: 10/334,277

(22) Filed: Jan. 2, 2003

(65) Prior Publication Data

US 2004/0129744 A1 Jul. 8, 2004

(51) Int. Cl.
*A41D 27/22* (2006.01)

(52) U.S. Cl. ..... 223/94
(58) Field of Classification Search ..... 223/94, 223/89
See application file for complete search history.

(56) References Cited

U.S. PATENT DOCUMENTS 589,901 A * 9/1897 Lincoln et al. ..... 223/94
923,786 A * 6/1909 Gerachi ..... 223/94
959,687 A * 5/1910 Altermatt ..... 223/94
1,876,237 A * 9/1932 Jackson ..... 292/256.73
2,425,475 A * 8/1947 Isaacson ..... 223/94
2,509,754 A * 5/1950 Badalamenti ..... 223/94
2,518,367 A * 8/1950 Penhallegon ..... 223/94
2,906,442 A * 9/1959 McNut ..... 223/94
3,285,118 A * 11/1966 Elkins ..... 411/346
3,315,854 A * 4/1967 Glisson et al. ..... 223/94
3,513,746 A * 5/1970 Forsberg ..... 411/346
3,531,028 A * 9/1970 Vazquez ..... 223/94
4,114,786 A * 9/1978 Wiese ..... 223/94
4,116,104 A * 9/1978 Kenndy ..... 411/427
4,117,960 A * 10/1978 Bengsch et al. ..... 223/94
4,227,632 A * 10/1980 Collis ..... 223/94
4,813,581 A * 3/1989 LaMont ..... 223/94
4,988,021 A * 1/1991 Adams et al. ..... 223/94
5,480,076 A * 1/1996 Siegel et al. ..... 223/94

* cited by examiner

*Primary Examiner*—John J. Calvert
*Assistant Examiner*—James G Smith
(74) *Attorney, Agent, or Firm*—Eugene Oak

(57) ABSTRACT

A hanger folding and expanding in a direction parallel to the hook, for narrow neck top wears is comprised of, including but not limited to, a spring, two solid wings, a pivot pin, a hook, and a member connecting the hook and a pivot pin.

1 Claim, 5 Drawing Sheets

FOLDING AND EXPANDING TOP WEAR HANGER

BACKGROUND OF THE INVENTION

While hanging a T-shirt on a coat hanger, it is very inconvenient to put the hanger into a top wear through the narrow neck. Most of the users put the hanger in from the bottom of the top wears. Even for so retractable hangers, it is not easy to put the hanger into a narrow neck of a garment with one hand. It is the purpose of this invention to provide a novel hanger easy to put into a top wear through the neck with one hand holding the garment and the other hand folding the hanger.

1. Field of the Invention

The present invention relates to a one touch folding and expanding hanger for narrow neck top wears.

2. Description of the Prior Art

U.S. Pat. No. 589,901 to Lincoln and Summerfield, U.S. Pat. No. 923,786 to Gerachi, U.S. Pat. No. 959,687 to Altermatt, U.S. Pat. No. 2,290,772 to Weingarten, U.S. Pat. No. 2,425,475 to Isaacson, U.S. Pat. No. 2,509,754 to Badalamenti, U.S. Pat. No. 2,518,367 to Oenhallegon, U.S. Pat. No. 2,906,442 to McNutt, U.S. Pat. No. 3,531,028 to Vazquez, U.S. Pat. No. 4,114,786 to Wiese, U.S. Pat. No. 4,117,960 to Bengsch et al., U.S. Pat. No. 4,227,632 to Collis, U.S. Patent to LaMont, and U.S. Pat. No. 4,988,021 to Adams et al. illustrate foldable and collapsible cloths hanger assemblies having a member that enables folding of the wings. The members of the prior arts are very sophisticate and bulky compared to the simple function of the cloths hanger.

U.S. Pat. No. 1,876,237 to Jackson. U.S. Pat. No. 3,285,118 to Elkins et al., U.S. Pat. No. 3,513,746 to Forsberg, U.S. Pat. No. 4,116,104 to Kennedy illustrate anchor nuts comprised of a butterfly wire spring or ribbon spring, two folded wings, a pivot pin and a nut. The anchoring nuts of the prior arts utilize short wings to hold weights behind a wall. The wings of nuts are made of very rigid metal and their cross sectional shape is one side opened square to sustain the heavy weight. A nut must be located at the center of the two wings and pivot pin to receive the bolt and let it pass through the nut. Therefore, two pivot pins are needed at the side of the wings or a pivot pin connected to a nut should be utilized.

None of the prior arts teaches a hanger that folds and expands in a direction opposite to the hook of a hanger for narrow neck upper ears of this invention comprised of, including but not limited to, a spring, solid wings, a pivot pin, a hook, and a member connecting the hook and pivot pin.

SUMMARY OF THE INVENTION

It is the purpose of this invention to provide a novel folding and expanding hanger for narrow neck top wears. It is comprised of, including but not limited to, a spring, two solid wings, a pivot pin, a hook, and a member connecting the hook and pivot pin. The spring, coiled around at the center of the pivot pin, renders a repulsion force for thrusting the wings to the extended position. The two solid wings have inner space for receiving the spring. The pivot pin is pivotably connected to one end of the two wings. The hook, which has a groove for finger, is connected to a member, which has two hands anchored to the pivot pin at both sides of the spring. The hook may be connected directly to a spring, which has two extended wings of 5 to 20 cm long. The other ends of two wings may be broader than the opposite ends for sustaining the shape of the upper wears. The cross sectional shape of the wings are, including but not limited to, a circle, a hemi circle, a pizza slice shape, a triangle, a square, a pentagon, a hexagon and combination of those geometrical shapes. The novel structure of the hanger of this invention enables a user easily put a hanger into the narrow neck of, including but not limited to, a round T-neck shirt, a buttoned men's dress shirt, and a ladies blouse by folding the wings inwardly and push the hanger into the neck of the top wears. By releasing the wings, the hanger holds the shape of the top wear.

DETAILED DESCRIPTION OF THE PREFERRED EMBODIMENT

Figure 1:
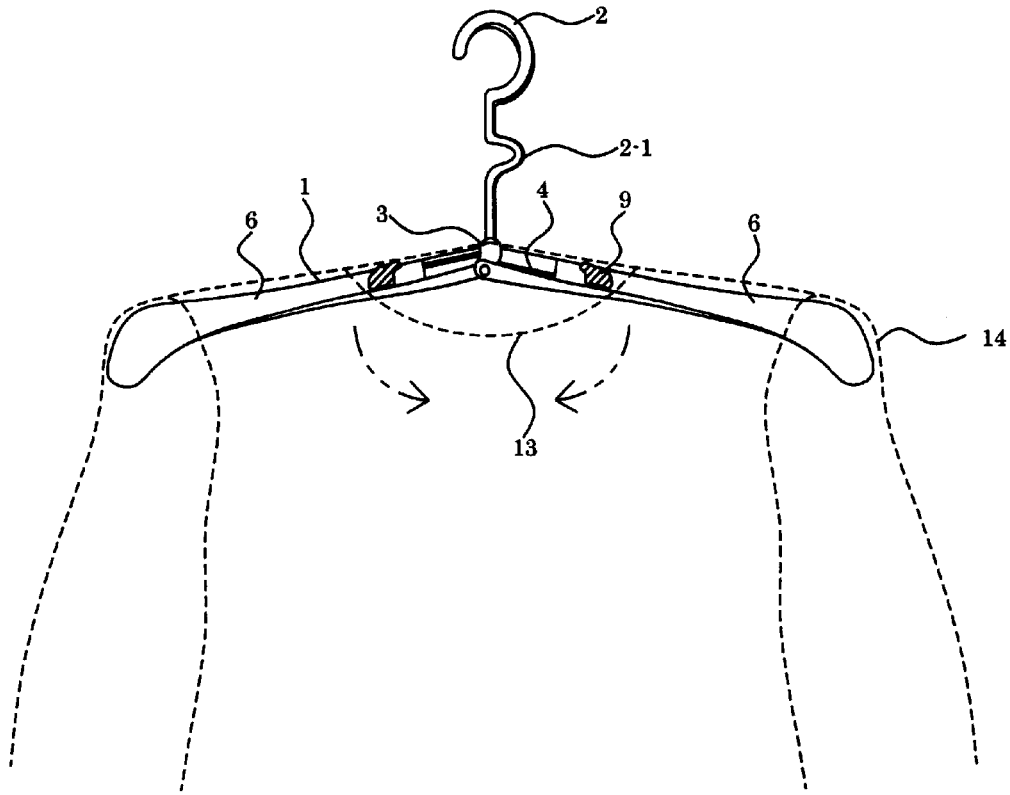
FIG. 1 is a perspective view of hanger of this invention when expanded.
Figure 2:
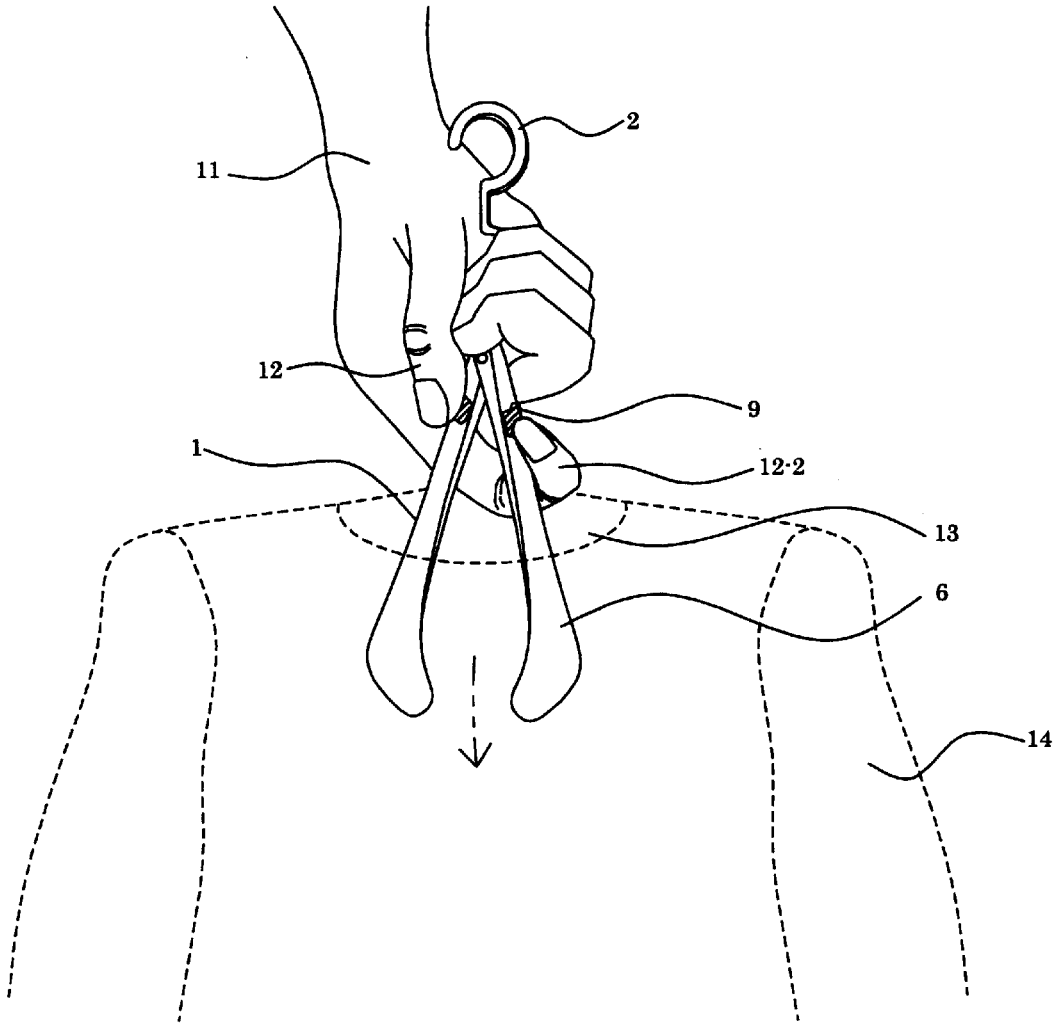
FIG. 2 shows a perspective view of how to fold the hanger when putting the hanger into a narrow neck of a top wear.

FIG. 1 is a perspective view of the upper wear hanger (1) of this invention when expanded to support a top wear (14) with a narrow neck (13). FIG. 2 is a perspective view of how to fold the hanger (1) when putting the hanger (1) into a narrow neck (13) of a top wear (14). When a user hold the hanger hook (2) with one hand (11) and Push the wings (6) at the mark (9) with thumb (12) and index finger (12-2) of the hand (11), the hanger (1) is folded to the opposite direction of the hook narrow enough to allow an easy access through the narrow neck (13) of the top wear (14). The distorted portion (2-1) of the hook receives the left three fingers (12-1) of the hand (11) and prevents the hand from sliding to the backwards. By releasing the wings (6), the hanger (1) returns to the expanded mode in FIG. 1 and maintains the shape of the top wear (14).

Figure 3:
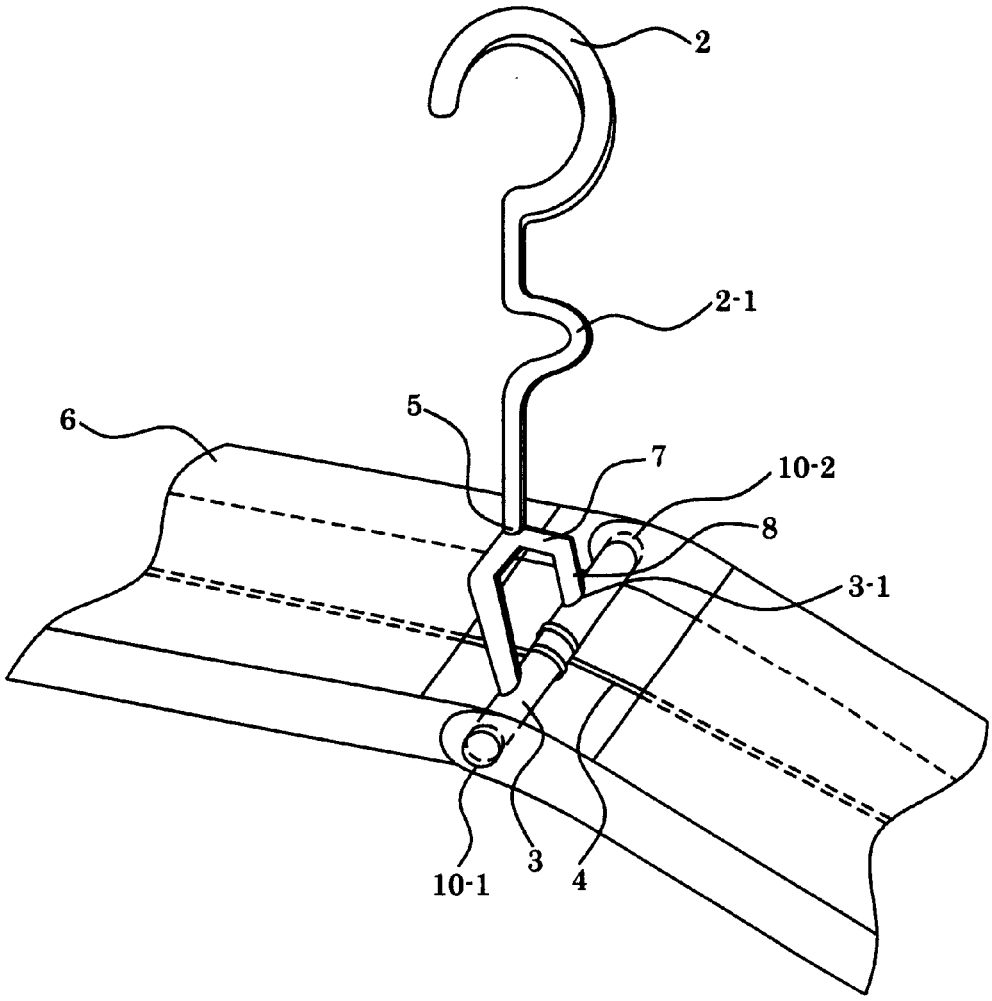
FIG. 3 is an enlarged drawing of connections of a hook, a pivot pin, a butterfly wire spring, a hook-holding member, and two wings.

FIG. 3 is an enlarged drawing of connections of a hook (2), a pivot pin (3), a butterfly wire spring (4), a hook-holding member (5), and two wings (6). The hook (2) has a groove (2-1) for holding user's fingers and is connected to the holding member (5).

Figure 4:
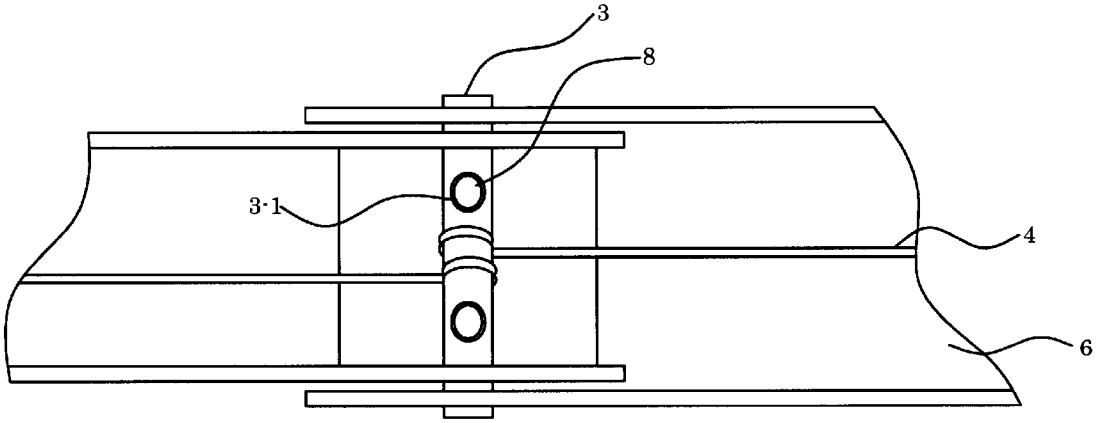
FIG. 4 is a bottom view of the connections of the pivot pin, the spring, bottom of the hook-holding member, and the wings.

The holding member (5) has two arms (7). One end (8) of each arms are fixed to the pivot pin (3) through the holes (3-1) on the pin (3). A butterfly wire spring (4) is mounted on the central part of the pivot pin (3). The pivot pin (3) is engaged through the two pivot pin holes (10-1) and (10-2). FIG. 4 is a bottom holding member (8), and the wings (6), showing the relative positions of the parts around the pivot pin (3). When a user hold the hanger hook (2) with one hand (11) and push the wings (6) at the mark (9) with two fingers (12) of the hand (11), the hanger (1) is folded narrow enough to allow easy access through the narrow neck (13) of the top wear (14) as shown in FIG. 2. The distorted neck (2-1) receives the left three fingers (12-1) of the hand (11) and prevents the hand from sliding to the backwards. By releasing the wings (6), the hanger (1) returns to the expanded mod in FIG. 1 and maintains the shape of the top wear (14).

Figure 5:
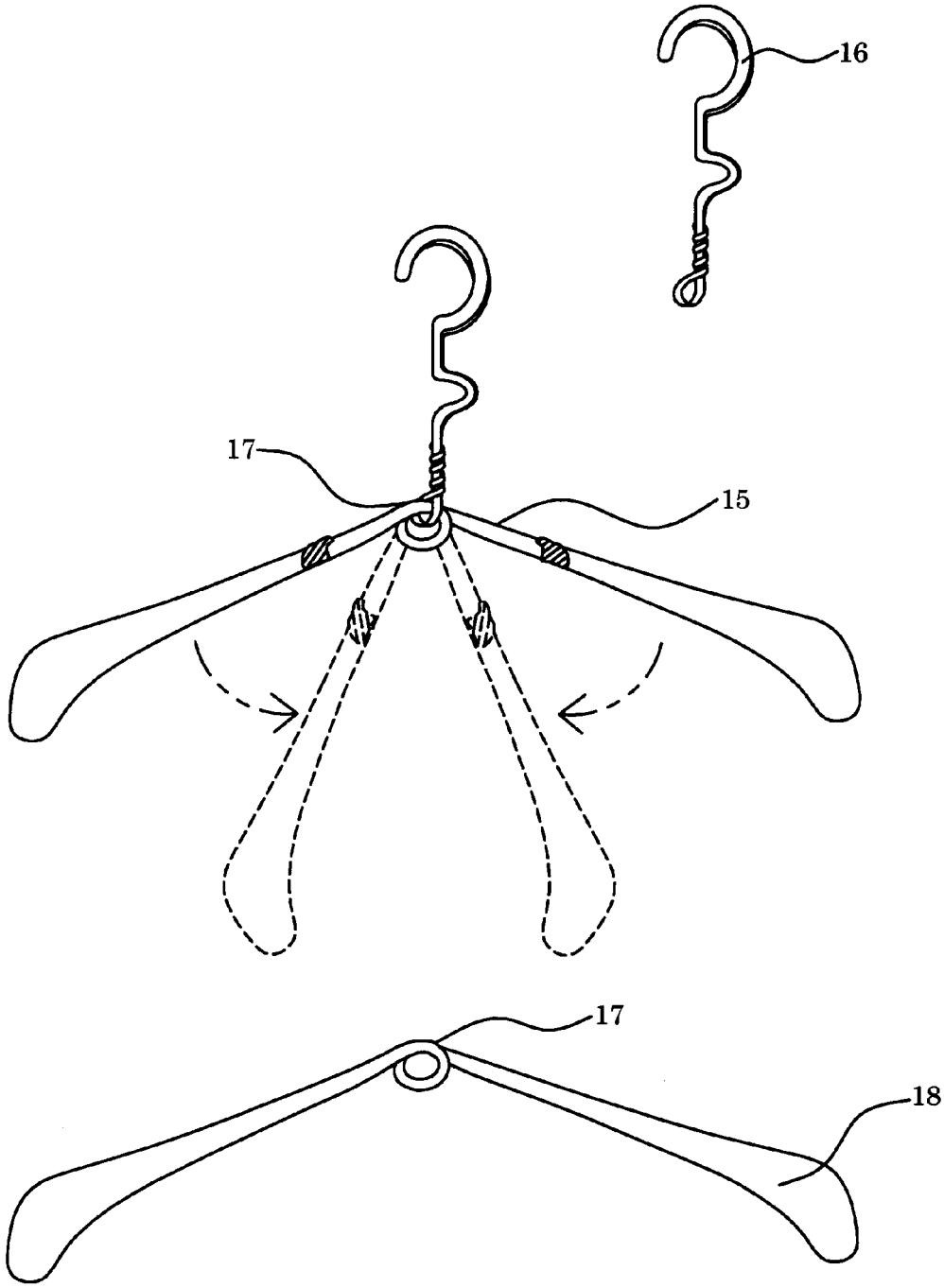
FIG. 5 is a perspective view of another embodiment of the hanger of this invention when expanded.

FIG. 5 is a perspective view of another embodiment of the hanger of this invention (15). The hanger (15) is comprised of a hook (16) and an extended and deformed ribbon spring (17) or butterfly wire spring (17). The extended wing portion (18) may come from the spring (17) by stretching them. Other light materials such as plastic, tin, aluminum, hard board and wood can be utilized as the extended wing portion (18) by connecting them to the spring (17) by, including but not limited to, welding, bolting and riveting.

What is claimed is:

1. A hanger, folding and expanding in a direction parallel to the hook, for narrow neck top wears is comprised of 1) a butterfly wire spring, which renders a repulsion force for thrusting the wings to the extended position, 2) two solid wings, having an inner space for receiving the butterfly wire spring and one end of the two wings being pivotably connected by a pivot pin, 3) a holding member connecting the hook and the pivot pin, 4) the pivot pin having two holes for receiving the two arms of the holding member connected to a hook, 5) the hook having the groove for holding user's fingers.

* * * * *